US008414412B2

(12) United States Patent
Kim

(10) Patent No.: US 8,414,412 B2
(45) Date of Patent: Apr. 9, 2013

(54) PRACTICE GOLF CLUB CAPABLE OF ADJUSTING HEAD SPEED

(75) Inventor: Yung Deuk Kim, Goyang-si (KR)

(73) Assignee: Yung Deuk Kim, Gyeonggi-do (KR)

( * ) Notice: Subject to any disclaimer, the term of this patent is extended or adjusted under 35 U.S.C. 154(b) by 0 days.

(21) Appl. No.: 13/202,087

(22) PCT Filed: Feb. 17, 2010

(86) PCT No.: PCT/KR2010/000980
§ 371 (c)(1),
(2), (4) Date: Aug. 17, 2011

(87) PCT Pub. No.: WO2010/095850
PCT Pub. Date: Aug. 26, 2010

(65) Prior Publication Data

US 2011/0300963 A1 Dec. 8, 2011

(30) Foreign Application Priority Data

Feb. 18, 2009 (KR) ..... 10-2009-0013181

(51) Int. Cl.
*A63B 69/36* (2006.01)

(52) U.S. Cl. ..... 473/234; 473/219; 473/223; 473/224; 473/231

(58) Field of Classification Search ..... None
See application file for complete search history.

(56) References Cited

U.S. PATENT DOCUMENTS 3,113,782 A * 12/1963 Guier ..... 473/234
(Continued)

FOREIGN PATENT DOCUMENTS

| | | | |
|---|---|---|---|
| JP | 2002-065922 | A | 3/2002 |
| KR | 20-0410215 | Y1 | 3/2006 |
| KR | 10-0651137 | B1 | 12/2006 |
| KR | 10-0832098 | B1 | 5/2008 |

OTHER PUBLICATIONS

International Search Report for PCT/KR2010/000980 dated Oct. 4, 2010.

*Primary Examiner* — Raleigh W Chiu
(74) *Attorney, Agent, or Firm* — IP&T Group LLP

(57) ABSTRACT

The present invention relates to a practice golf club capable of adjusting head speed having a head (H) attached to an end of a shaft(S) having a grip (G), from which an impact sound is generated through a swing operation, wherein the head (H) includes: a first body (100) coupled to the end of the shaft (S); a second body (110) having a tubular shape, both ends of which are open and adapted to be screw-coupled to the rear end of the first body (100); a moving weight (140) movably disposed inside the second body (110); a magnet (180) adapted to fix the moving weight (140) to the front end portion of the second body (110) by means of a magnetic force thereof; adjustment means adapted to adjust the gap between the magnet (180) and the moving weight (140) so as to control the strength of the magnetic force of the magnet (180) pulling the moving weight (140); a cap (120) screw-coupled to a rear end of the second body (110); and return means interposed between the cap (120) and the moving weight (140) to return the moving weight (140) to the original position when the moving weight (140) momentarily moves by centrifugal force and collides against the cap (120) to generate an impact sound.

11 Claims, 7 Drawing Sheets

U.S. PATENT DOCUMENTS

| | | | | |
|---|---|---|---|---|
| 3,254,895 | A * | 6/1966 | Haas | 473/234 |
| 3,572,706 | A * | 3/1971 | Schroder | 473/234 |
| 3,575,419 | A * | 4/1971 | Davis | 473/234 |
| 4,515,368 | A * | 5/1985 | Petitjean | 473/224 |
| 4,819,941 | A * | 4/1989 | Tanaka | 473/234 |
| 4,878,672 | A * | 11/1989 | Lukasiewicz | 473/233 |
| 5,868,634 | A * | 2/1999 | Choi et al. | 473/224 |
| 7,001,283 | B2 * | 2/2006 | Jeong | 473/219 |
| 7,331,875 | B2 * | 2/2008 | Sherman | 473/221 |
| 7,727,090 | B2 * | 6/2010 | Gant | 473/453 |
| 2005/0261070 | A1 * | 11/2005 | Jeong | 473/219 |
| 2007/0155525 | A1 * | 7/2007 | Davenport et al. | 473/256 |
| 2011/0300963 | A1 * | 12/2011 | Kim | 473/234 |
| 2012/0021847 | A1 * | 1/2012 | Kim | 473/219 |
| 2012/0115626 | A1 * | 5/2012 | Davenport | 473/223 |

* cited by examiner

PRACTICE GOLF CLUB CAPABLE OF ADJUSTING HEAD SPEED

CROSS-REFERENCE TO RELATED APPLICATIONS

This application is a National Phase of International Application No. PCT/KR2010/000980, which was filed on Feb. 17, 2010, and which claims priority to and the benefit of Korean Patent Application No. 10-2009-0013181, filed on Feb. 18, 2009, and the disclosures of which are hereby incorporated herein by reference in their entireties.

TECHNICAL FIELD

The present invention relates to a practice golf club in which the impact sound generated when a moving weight in a head moves outwardly by means of a centrifugal force during a swing operation and hits the inside of the head at the point of impact and the feeling transmitted to the hand of a trainee enable the trainee to judge whether or not the swing operation is accurately carried out, and a practice golf club capable of adjusting head speed that precisely adjusts a force for suppressing the movement of a moving weight and generates an impact sound at an accurate point of impact only when a head speed required for the flight distance of a golf ball is achieved, thereby allowing a trainee to learn the degree of head speed according to the swing operation.

BACKGROUND ART

As shown in FIG. 1, a conventional practice golf club has a head H attached to an end of a shaft S having a grip, from which an impact sound is generated.

The head H includes a sliding space portion 10 formed inside bodies 1 and 2, a moving weight 20 mounted inside the sliding space portion 10, and a spring 30 disposed at the front portion of the moving weight 20, and thus, if the shaft S swings, the moving weight 20 compresses the spring 30 by means of the centrifugal force generated by the swing operation and moves to hit the inner front end of the sliding space portion 10, thereby generating the impact sound therefrom.

At the time of finishing operation after the hitting, the moving weight 20 is returned to its original position by means of the elastic force of the spring 30 and hits the rear end portion of the sliding space portion 10, thereby generating the impact sound indicating that the hitting is completely finished.

Further, the head H includes a ball stopper 40 mounted at an initial position section of the moving weight 20 and serving as a trigger elastically pressurizing the side portion of the moving weight 20 to prevent the impact sound from being generated from the moving weight 20 even by a slight swing operation, such that the movement of the moving weight 20 is suppressed. Thus, only when a given centrifugal force is over, the moving weight 20 is moved forwardly to generate the impact sound therefrom.

However, the conventional practice golf club is structured wherein the time point at which the impact sound is generated is not adjustable. Therefore, only if a swing operation is carried out over a predetermined speed, the impact sound is generated, such that a substantially strong force may be required in generating the impact sound in accordance with a trainee's physical conditions or his swing speed capability, and in some cases, the impact sound is already generated before the time point of the impact to fail to learn whether or not an accurate swing operation is carried out. This is because the swing speed of the golf club differs in accordance with the individual's physical conditions to cause the time points reaching set head speeds to be different from one another.

Hence, the conventional practice golf club does not provide high efficiencies in the swing practice, and the above-mentioned problems have been continuously proposed by a lot of trainees. However, no product solving the above-mentioned problems suffered in the conventional practice golf club has been introduced to the market.

The above-mentioned problems may be caused by the individual's physical conditions and also by the characteristics of the practice golf club itself. That is, the time points of the generation of the impact sound are varied by the elasticity difference of the spring 30 returning the moving weight 20 or by the elastic force of the ball stopper 40 suppressing the movement of the moving weight 20, thereby causing the reliability of the practice golf club to be deteriorated.

Technical Problem

Accordingly, the present invention has been made in view of the above-mentioned problems occurring in the prior art, and it is an object of the present invention to provide a practice golf club capable of adjusting a head speed that allows the head speed for generating an impact sound to be arbitrarily adjusted by a trainee, thereby enabling swing practice to be carried out in accordance with individual differences.

It is another object of the present invention to provide a practice golf club capable of adjusting a head speed that allows a degree of adjusting the head speed for generating an impact sound to be checked and adjusted by a trainee's eyes, such that the head speed required for the target flight distance of a golf ball is set to practice the swing operation in accordance with the set head speed, thereby learning an accurate degree of head speed in accordance with the flight distance of the golf ball.

Technical Solution

To accomplish the above objects, according to the present invention, there is provided a practice golf club capable of adjusting a head speed having a head attached to an end of a shaft having a grip, from which an impact sound is generated through a swing operation, wherein the head includes: a first body coupled to the end of the shaft; a second body having a tubular shape, both ends of which are open and adapted to be screw-coupled to the rear end of the first body; a moving weight movably disposed inside the second body; a magnet adapted to fix the moving weight to the front end portion of the second body by means of a magnetic force thereof; adjustment means adapted to adjust the gap between the magnet and the moving weight so as to control the strength of the magnetic force of the magnet pulling the moving weight; a cap screw-coupled to a rear end of the second body; and return means interposed between the cap and the moving weight to return the moving weight to the original position when the moving weight momentarily moves by centrifugal force and collides against the cap to generate an impact sound.

According to the present invention, preferably, the adjustment means adjusts the distance between the magnet and the moving weight by forming a stepped projection along the inner periphery of the second body contacted with the first body to restrict the movement of the moving weight toward the first body and by fixedly disposing the magnet inside the first body correspondingly to the stepped projection to move the second body screw-coupled to the first body forwardly and backwardly from the first body by forward and reverse rotation.

According to the present invention, preferably, the adjustment means adjusts the distance between the magnet and the moving weight by forming the stepped projection along the inner periphery of the second body contacted with the first body, by fixedly disposing the magnet having a shaft hole formed at the center thereof on the stepped projection, by forming a screw hole at the inside of the first body corresponding to the shaft hole, by screw-coupling a gap adjustment screw to the screw hole through the shaft hole, and by moving the second body screw-coupled to the first body forwardly and backwardly through the forward and reverse rotation, such that the gap adjustment screw is inserted into and drawn from the shaft hole to push the moving weight, thereby adjusting the distance between the moving weight and the magnet.

According to the present invention, preferably, so as to adjust the strength of the magnetic force applied to the moving weight by varying the distance between the magnet inside the first body and the moving weight inside the second body by means of the screw rotation of the second body screw-coupled to the first body and thus to allow the degree of adjustment to be checked by a trainee's eyes, the first body has a reference scale formed on one side of the outer periphery corresponding to the second body and the second body has a plurality of flight distance adjustment scales formed along the outer periphery thereof corresponding to the first body, the plurality of flight distance adjustment scales indicating head speeds proportional to the strength of the magnetic force and the distances (meters and yards) obtained in accordance with the head speeds.

Advantageous Effect

According to the present invention, as mentioned above, there is provided a practice golf club capable of adjusting a head speed that allows one of the flight distance adjustment scales formed on the second body to be positioned correspondingly to the reference scale formed on the first body to adjust the distance between the magnet and the moving weight, such that the impact sound is generated at the accurate position of impact only when the head speed required for the target flight distance of a golf ball is achieved during the swing operation, which enables the trainee to independently learn the degree of head speed required for the target flight distance of a golf ball.

In addition, even when a full swing operation is carried out, the head speed can be adjusted in accordance with the trainee's physical conditions or his swing speed capability, such that the swing operation can be accurately practiced.

BEST MODE FOR INVENTION

Hereinafter, an explanation on a practice golf club according to the present invention will be in detail given with reference to the attached drawings.

Figure 1:
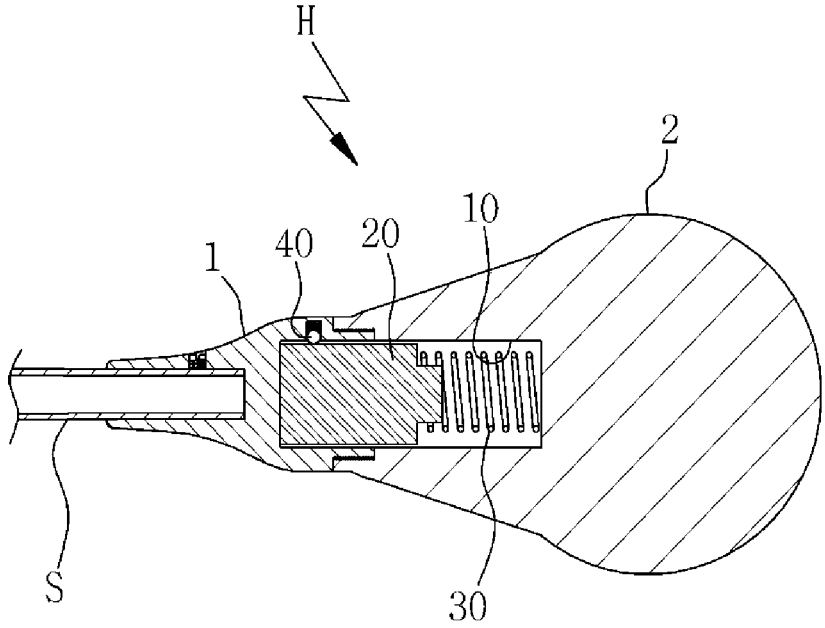
FIG. 1 is a sectional view showing a structure of a conventional practice golf club.
Figure 2:
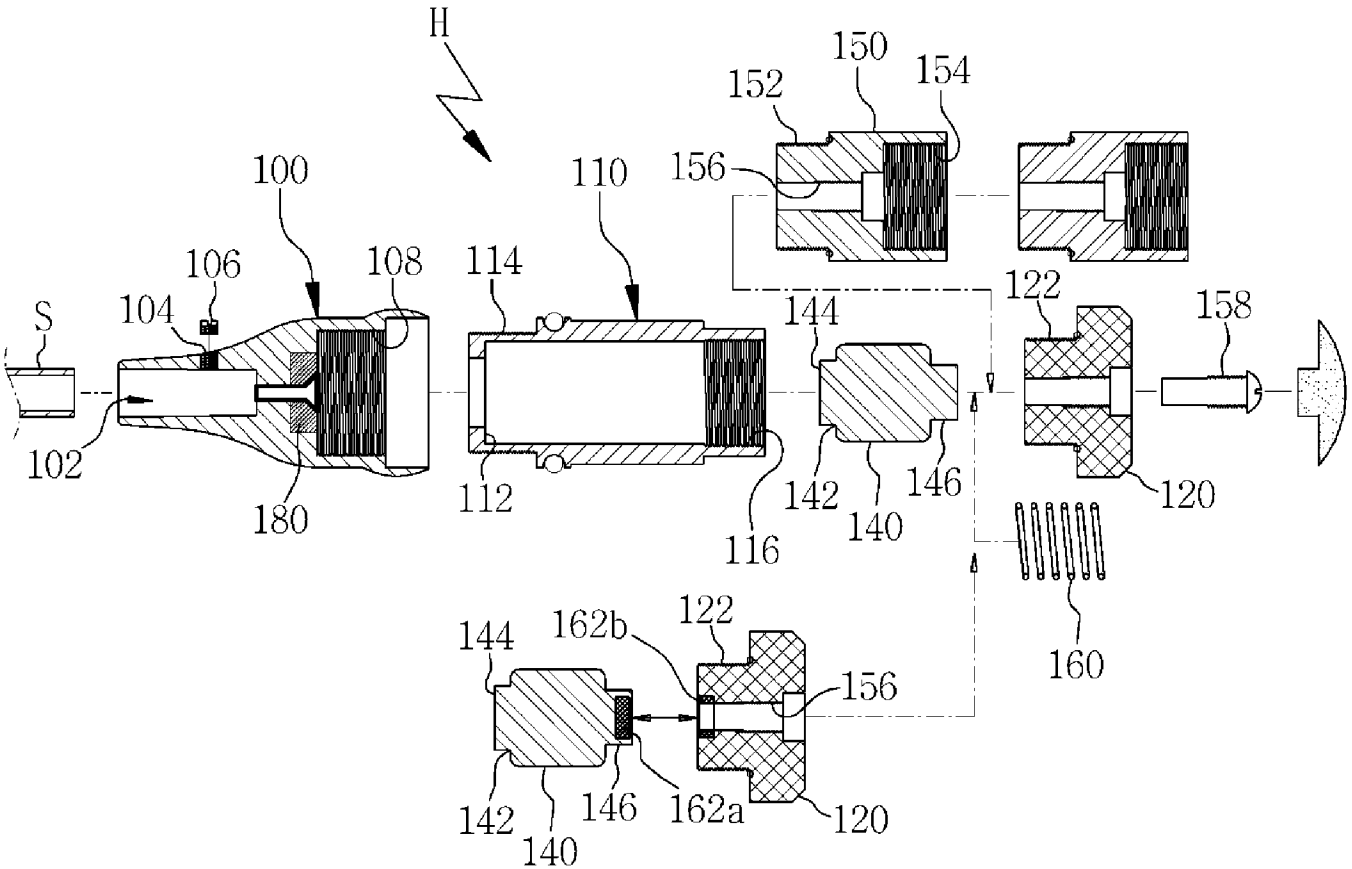
FIG. 2 is a separate sectional view showing a practice golf club according to a first embodiment of the present invention.
Figure 3:
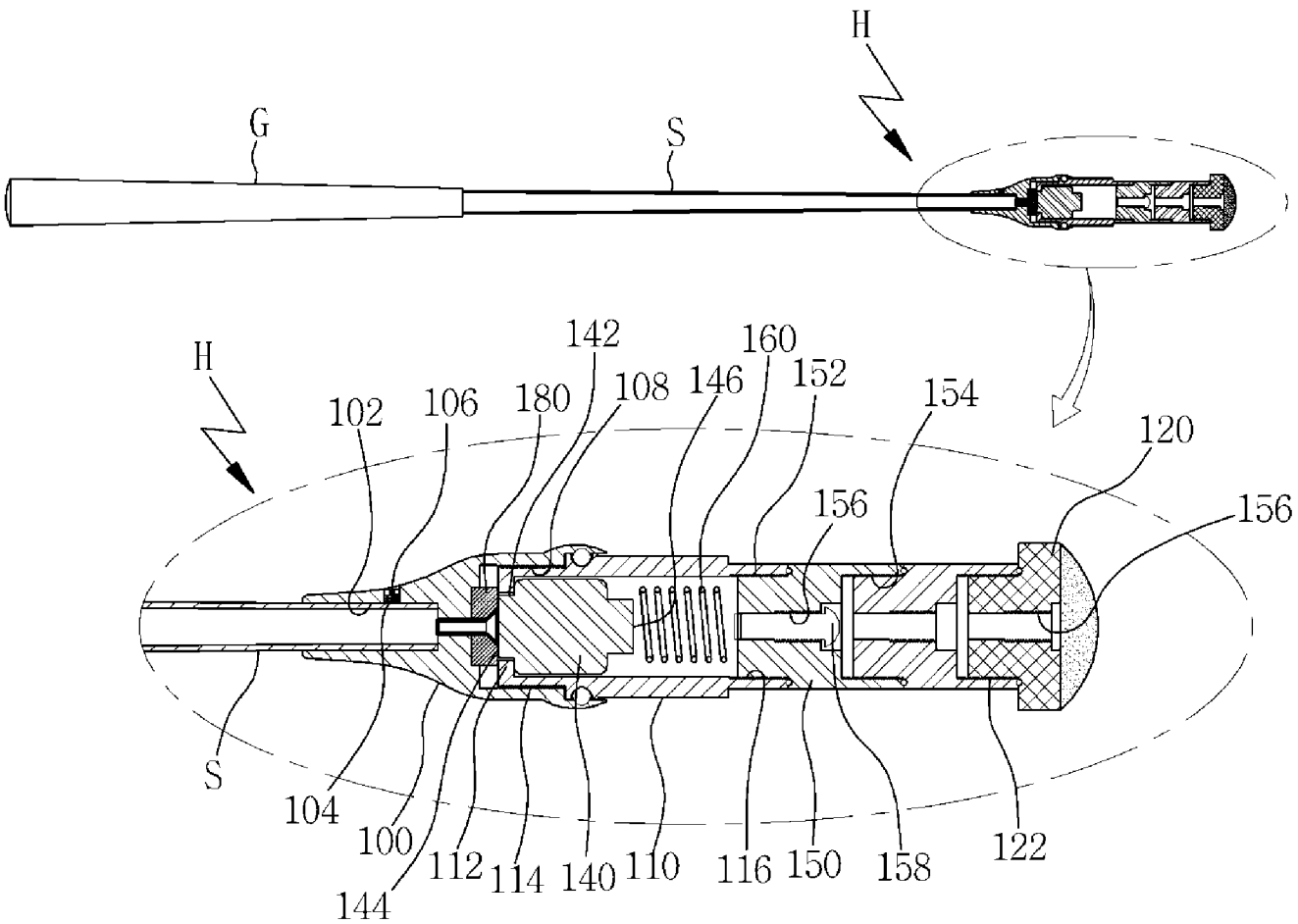
FIG. 3 is an assembled sectional view showing the practice golf club according to the first embodiment of the present invention.
Figure 4:
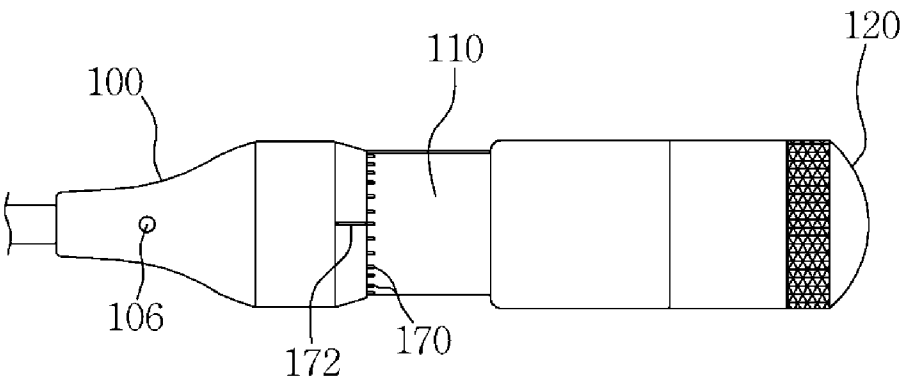
FIG. 4 is a front view showing the practice golf club according to the first embodiment of the present invention.

FIG. 2 is a separate sectional view showing a practice golf club according to a first embodiment of the present invention, FIG. 3 is an assembled sectional view showing the practice golf club according to the first embodiment of the present invention, and FIG. 4 is a front view showing the practice golf club according to the first embodiment of the present invention.

As shown in FIGS. 2 to 4, a practice golf club capable of adjusting head speed according to the first embodiment of the present invention largely includes a shaft S having a grip G and a head H mounted at the rear portion of the shaft S to generate an impact sound through a swing operation.

Also, the head H includes a first body 100 coupled to the rear end of the shaft S, a second body 110 screw-coupled to the rear portion of the first body 100, a moving weight 140 movably disposed inside the second body 110, a magnet 180 adapted to fix the moving weight 140 to the front end portion of the second body 110 by means of a magnetic force thereof, adjustment means adapted to adjust the gap between the magnet 180 and the moving weight 140 so as to control the strength of the magnetic force of the magnet 180 pulling the moving weight 140, a cap 120 screw-coupled to the rear end portion of the second body 110, and return means interposed between the cap 120 and the moving weight 140 to return the moving weight 140 to the original position.

The first body 100 of the head H has a shaft hole 102 formed on one side end portion thereof and a first female screw portion 108 formed at the other side end portion so as to screw-couple the second body 110 thereto. At this time, the first female screw portion 108 is deeply formed in such a manner as to screw-couple a second male screw portion 114 formed around the front end portion of the second body 110 thereto in a substantially deep depth.

Further, the first body 100 on which the shaft hole 102 is formed has a key groove 104 formed on the side portion thereof in such a manner as to be penetrated into the shaft hole 102 and a key 106 adapted to be fitted to the key groove 104. After the end portion of the shaft S is inserted into the first body 100, the key groove 104 is formed on the side portion of the first body 100 in such a manner as to be penetrated into the shaft hole 102, and then, the key 106 is fitted into the key groove 104, thereby achieving the rigid coupling between the shaft S and the first body 100. That is, the key groove 104 is formed of a screw hole and the key 106 is formed of a screw, such that the screw is insertedly coupled to the screw hole to compress the shaft S inserted into the shaft hole 102 thereagainst, thereby integrally coupling the first body 100 and the shaft S to each other.

The second body 110 of the head H is a tubular body opened at both sides thereof and has a stepped protrusion 112 formed along the inner periphery of the end portion corresponding to the first body 100 and the second male screw portion 114 formed around the front end periphery thereof in such a manner as to be screw-coupled to the first female screw portion 108 of the first body 100. The second body 110 is adjustable in the insertion depth into the first body 100 by means of forward and reverse rotation thereof. Further, the second body 110 has a second female screw portion 116 formed along the inner periphery of the other side end portion thereof in such a manner as to be coupled to the cap 120.

The moving weight 140 of the head H has a stepped groove 142 formed around one side end portion thereof so as to insertedly fit the stepped projection 112 thereto and to be inserted into the second body 110. If the inserted moving weight 140 is moved to the stepped projection 112, a protruded portion 144 formed naturally at the center portion of the stepped groove 142 formed along the periphery of the moving weight 140 is inserted into the inner space of the stepped projection 112. Further, the moving weight 140 has a spring support portion 146 formed along the end portion opposite to the stepped groove 142 thereof so as to support one side end of a return spring 160. If a centrifugal force is generated by a swing operation, the front surface of the spring support portion 146 is moved to the cap 120 and collides against the face of the cap 120 to generate an impact sound therefrom. The impact sound is similar to the hitting sound generated upon hitting a golf ball, thereby making it possible to provide feeling like hitting a golf ball.

The cap 120 has a third male screw portion 122 formed along one side periphery thereof so as to be screw-coupled to the second female screw portion 116 of the second body 110.

The head H further includes an auxiliary body 150 having a fourth male screw portion 152 formed along the front periphery thereof so as to be screw-coupled to the second female screw portion 116 of the second body 110 and a fourth female screw portion 154 formed along the rear periphery thereof so as to be coupled to the third male screw portion 122 of the cap 120 or the fourth male screw portion 152 of another auxiliary body 150 thereto.

The auxiliary body 150 may be provided plurally, and if necessary, the auxiliary body 150 is coupled to other auxiliary bodies one by one to increase the weight of the head H. Of course, the fourth female screw portion 154 positioned at the rear end portion of the last auxiliary body 150 is screw-coupled to the third male screw portion 122 of the cap 120. The formation of the auxiliary body 150 enables the weight of the head H to be increased or decreased in accordance with a trainee's preference.

Moreover, the head H of the practice golf club according to the first embodiment of the present invention has the adjustment means adapted to adjust a limit point of the centrifugal force generated by the swing operation at which the moving weight 140 attached to the magnet 180 is separated from the magnet 180.

Since the stepped projection 112 formed along the inner periphery of the second body 110 contacted with the first body 100 and the second body 110 are inserted into and drawn from the first body 100 by means of the forward and reverse rotation thereof, the moving weight 140 is moved forwardly and backwardly together with the second body 110 through the stepped projection 112, such that the distance between the moving weight 140 and the magnet 180 mounted inside the first body 100 can be varied, which is the function of the adjustment means.

That is, if the second body 110 is rotated clockwisely and moved backwardly, the moving weight 140 becomes distant from the magnet 180 fixed in the first body 100, thereby being far from the range of a magnetic force of the magnet 180. As a result, a force of pulling the moving weight 140 becomes small, and even with a relatively small centrifugal force, the moving weight 140 can be moved to the cap 120. Contrarily, if the second body 110 is moved to the first body 100, the moving weight 140 becomes close to the magnet 180, thereby providing a relatively strong magnetic force of the magnet 180 to the moving weight 140. As a result, a relatively strong centrifugal force is needed in separating the moving weight 140 from the magnet 180, and in this case, only when the swing is carried out at a faster speed, the moving weight 140 is separated from the magnet 180 to generate an impact sound therefrom.

On the other hand, the return means, which is adapted to return the moving weight 140 moved to the head H to its original position at which the magnet 180 is disposed, is formed of the return spring 160, and alternatively, the return means is formed of repulsive magnets 162*a* and 162*b* mounted on the facing faces of the moving weight 140 and the cap 120 in such a manner as to face the same poles as each other, such that the moving weight 140 is returned to its original position by means of the repulsive forces of the repulsive magnets 162*a* and 162*b*. The return spring 160 is made by cutting a long spring to a given length, and at this time, the differences in the lengths of the return springs occur by the cutting errors, which causes the elastic forces of the return springs 160 to be different from each other. Since the magnet generates a constant magnetic force therefrom, however, it can generate the returning force constantly.

Further, the second body 110 of the head H according to the practice golf club has a plurality of flight distance adjustment scales 170 formed along the end periphery thereof, and the first body 110 has a reference scale 172 formed on a given position of the outer periphery corresponding to the flight distance adjustment scales 170 of the second body 110. Especially, the flight distance adjustment scales 170 are provided in such a manner as to calculate head speeds required to get arbitrary flight distance, to produce forces for suppressing the movement of the moving weight 140 on the basis of the calculated head speeds, and to indicate that the separation distances between the magnet 180 and the moving weight 140 in accordance with the suppressing forces, which are of course seen through the trainee's eyes.

In other words, the distance between the magnet 180 inside the first body 100 and the moving weight 140 inside the second body 110 is varied by means of the screw rotation of the second body 110 screw-coupled to the first body 100, thereby adjusting the strength of the magnetic force applied to the moving weight 140, and in this case, the formation of the flight distance adjustment scales 170 enables the adjusting degrees to be checked by the trainee's eyes. That is, the flight distance adjustment scales 170 indicate the flight distances obtained in accordance with the head speeds proportional to the strength of the magnetic force pulling the moving weight 140.

The adjustment scales 170 are indicated with the head speeds important to trainees and real flight distances in accordance with the head speeds in a form of meters or yards, such that the trainees can practice real head speeds and their sense of distance, which makes it possible to achieve efficient practice and also makes them feel very interested in golf swing.

Hereinafter, an explanation on the operation of the practice golf club according to the first embodiment of the present invention will be given.

If a swing operation is carried out with the golf club in a state of grasping the grip G by the trainee's hands, the head H is rotated around the trainee's body, and a large centrifugal force is applied to the moving weight 140 mounted inside the head H to cause the moving weight 140 to be moved outwardly. If the moving force of the moving weight 140 is larger than the magnetic force fixing the moving weight 140, the moving weight 140 is moved toward the cap 120 and collides against the cap 120. Upon the collision, the moving weight 140 generates an impact sound therefrom. Contrarily, if the centrifugal force is smaller than the magnetic force pulling the moving weight 140, the moving weight 140 is not moved to the cap 120 and does not generate any impact sound therefrom. This means that full head speed is not obtained, and therefore, the trainee can practice faster swing operations to obtain appropriate head speeds.

If it is desired to generate the impact sound even in slight and slow swing operations through the decrease in the head speed, the second body 110 is rotated clockwisely to move backwardly. Through the backward movement, the moving weight 140 disposed inside the second body 110 becomes distant from the magnet 180 mounted inside the first body 100. While checking the flight distance adjustment scales 170 indicated around the periphery of the second body 110, the second body 110 is moved backwardly to a desired distance, such that even in slight and slow swing operations, the moving weight 140 is moved to generate the impact sound therefrom.

So as to generate the impact sound from the moving weight 140 at a fast head speed, to the contrary, the second body 110 is rotated counter-clockwisely and moved to the first body 100. In this case, the moving weight 140 disposed inside the second body 110 becomes close to the magnet 180 mounted inside the first body 100 and is positioned within a range of a strong magnetic force of the magnet 180. At this time, only when a substantially strong centrifugal force is applied, the moving weight 140 is separated from the magnet 180 and generates the impact sound therefrom. In this case, also, the flight distance adjustment scales 170 indicated on the second body 110 are adjusted correspondingly to the reference scale 172 on the first body 100.

Therefore, after the trainee using the practice golf club according to the present invention adjusts the flight distance adjustment scales 170 to obtain his target flight distance, he can practice the club head speed required for his target flight distance. That is, after the reference scale 172 is positioned correspondingly to the specific flight distance adjustment scale 170, if the swing operation is carried out, the moving weight 140 is moved by the strength of the centrifugal force to generate the impact sound therefrom. However, if an appropriate head speed is not obtained, the moving weight 140 is not moved to the outwardly and does not generate any impact sound therefrom. In case where the swing operation is carried out over the appropriate head speed, further, the impact sound is generated before the accurate time point of impact, thereby making the trainee feel that an excessively full swing operation is carried out.

When the impact sound is generated at the accurate time point of impact through the repetition of the above process, the trainee just learns the accurate head speed required for the target flight distance and masters getting the accurate head speed through the repeated practice of the swing operation.

On the other hand, if the swing operation is finished, the centrifugal force is removed to return the moving weight 140 to a position on which the magnet 180 is disposed by means of the elastic force of the return spring 160 or the repulsive forces of the repulsive magnets.

When the swing operation is practiced in the night, also, the practice golf club according to the present invention has a function of reducing the strength of the impact sound.

In more detail, the cap 120 has a screw hole 156 formed at the center thereof in such a manner as to be coupled to a sound adjustment screw 158, and in this case, the end portion of the sound adjustment screw 158 is inserted into or drawn from the second body 110. The sound adjustment screw 158 has a sound suppressing member mounted on the end portion thereof, and the sound suppressing member is formed of Teflon, acetal, or all kinds of materials having sound suppression functions.

Under the above structure, if the end portion of the sound adjustment screw 158 is protruded from the cap 120 on which the moving weight 140 collides, the moving weight 140 collides against the Teflon, acetal or the like as the sound suppressing member coupled on the end portion of the sound adjustment screw 158, thereby allowing the strength of the impact sound to be greatly reduced, and further, the impact force transmitted through the shaft S is sensed by the trainee's hands, such that the swing operation can be practiced with no big sound, which does not give any inconveniences to people around him.

Therefore, the strength of the impact sound can be controlled through the adjustment of the sound adjustment screw 158 mounted inside the cap 120.

The sound adjustment screw 158 is mounted inside the cap 120, but may be disposed inside the respective auxiliary bodies 150, thereby adjusting the strength of the impact sound.

Mode For Invention

Figure 5:
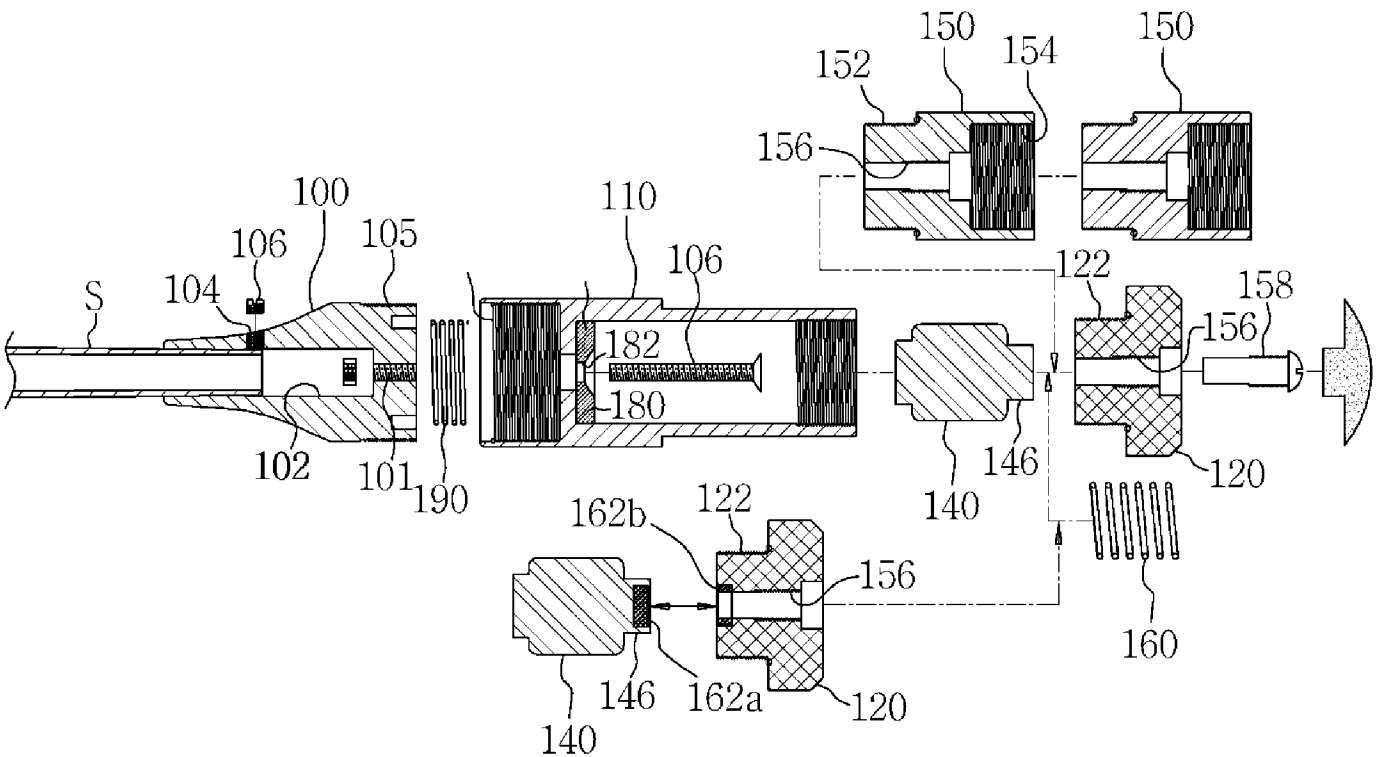
FIG. 5 is a separate sectional view showing a practice golf club according to a second embodiment of the present invention.
Figure 6:
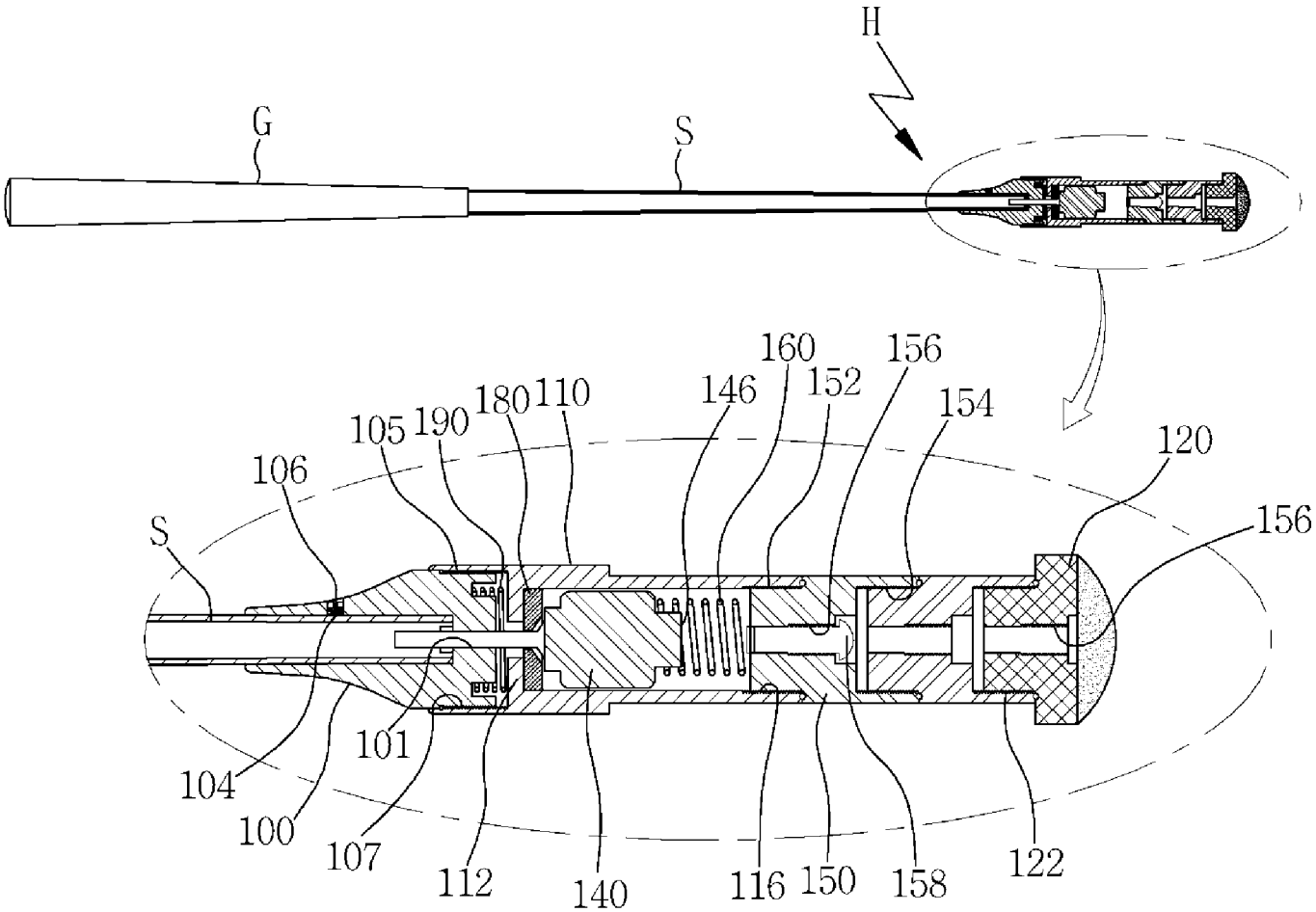
FIG. 6 is an assembled sectional view showing the practice golf club according to the second embodiment of the present invention.

FIG. 5 is a separate sectional view showing a practice golf club according to a second embodiment of the present invention, and FIG. 6 is an assembled sectional view showing the practice golf club according to the second embodiment of the present invention.

As shown, the second embodiment of the present invention is different from the first embodiment of the present invention in the configuration of the adjustment means.

The second body 110 has the stepped projection 112 formed along the inner periphery of the front end thereof, and the magnet 180 pulling the moving weight 140 by means of the magnetic force is mounted inside the stepped projection 112. The magnet 180 has a shaft hole 182 formed at the center thereof, and the first body 100 has a screw hole 101 formed at the inside corresponding to the shaft hole 182. A gap adjustment screw 103 is coupled to the screw hole 101 through the shaft hole 182, and if the second body 110 is moved forwardly and backwardly through the forward and reverse rotation, the gap adjustment screw 103 coupled to the first body 100 is moved forwardly and backwardly together with the first body 100 and is inserted into the second body 110 to push the moving weight 140, thereby adjusting the distance between the moving weight 140 and the magnet 180.

A spring 190 is elastically mounted between the second body 110 and the first body 100 so as to apply an elastic force to the respective bodies.

So as to assemble the practice golf club according to the second embodiment of the present invention, first, the second body 110 is coupled to the first body 100, and the distance between the magnet 180 and the moving weight 180 is made at an adjustment range limit point. Next, the gap adjustment screw 103 is insertedly coupled to the screw hole 101 through the second body 110 and rigidly fastened thereto. After that, the moving weight 140, the return spring 160, the cap 120 or the auxiliary bodies 150 are coupled to one another, thereby finishing the assembling process. In this case, if the second body 110 is moved backwardly over the limit point of the distance adjustment range, the head portion of the gap adjustment screw 103 is locked to the second body 110 or the shaft hole 182 of the magnet 180 mounted inside the second body 110, thereby preventing the gap adjustment screw 103 from being moved further.

That is, the second body 110 is screw-coupled to the first body 100, and at the same time, the gap adjustment screw 103 is screw-coupled to a female screw portion 107 of the first body 100, thereby obtaining double coupling. Especially, since the pitch between the second body 110 and the first body 100 is different from that between the second body 110 and the gap adjustment screw 103, when the second body 110 is separated from the first body 100 over the limit of the gap adjustment screw 103, the second body 110 is locked to the head portion of the gap adjustment screw 103 and is not separated from the first body 100 anymore, thereby preventing the abnormal separation of the second body 110 from the first body 100.

According to the second embodiment of the present invention, the gap adjustment screw 103 serves as a safety device firmly connecting the second body 110 and the first body 100.

Further, since the gap adjustment screw 103 and the spring 190 are mounted between the first body 100 and the second body 110, the first body 100 and the second body 110 should be somewhat changed in their configuration so as to obtain space in which the gap adjustment screw 103 and the spring 190 are accommodated. That is, the first body 100 has a male screw portion 105 formed on the end portion corresponding to the second body 110, and the second body 110 has the female screw portion 107 formed correspondingly to the male screw portion 105 of the first body 100, thereby screw-coupling the male screw portion 105 and the female screw portion 107 to each other.

The second embodiment of the present invention under the above-mentioned structure has the same head speed setting function as the first embodiment of the present invention.

Figure 7:
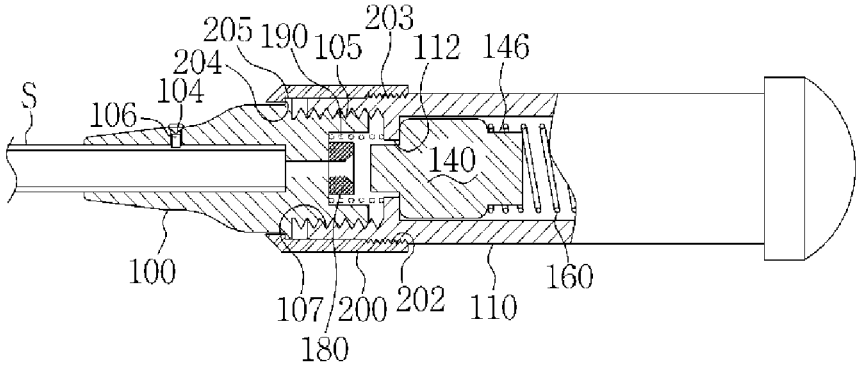
FIGS. 7 and 8 are sectional views showing a structure of a practice golf club according to a third embodiment of the present invention.
Figure 8:
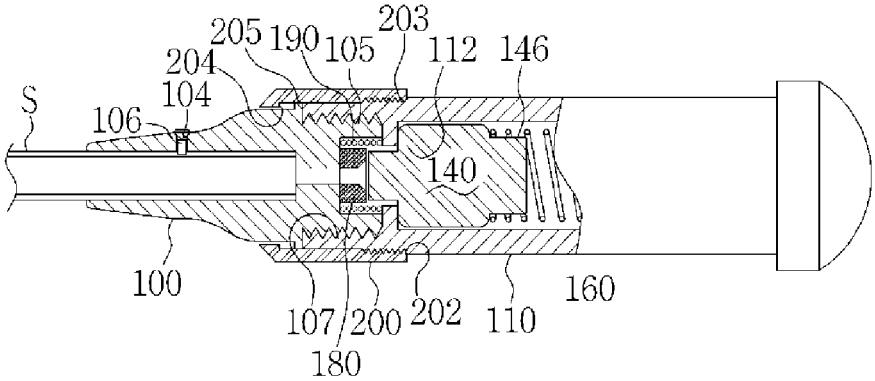

FIGS. 7 and 8 are sectional views showing a structure of a practice golf club according to a third embodiment of the present invention.

According to the third embodiment of the present invention, as shown in FIGS. 7 and 8, the head H includes a safety device preventing the first body 100 screw-coupled to the second body 110 from being escaped from the second body 110 by means of abnormal causes.

That is, the first body 100 has a locking projection 204 formed along the periphery thereof, and an escape prevention body 200 having a larger inner diameter than the first body 100 is screw-coupled to the second body 110 such that the first body 100 screw-coupled to the second body 110 is moved forwardly and backwardly inside the escape prevention body 200 by means of screw rotation. Further, the escape prevention body 200 has an escape prevention protrusion 205 formed along the inner periphery of one side end portion thereof in such a manner as to be locked correspondingly to the locking projection 204, thereby preventing the first body 100 from being moved backwardly over the head speed adjustment range and escaped from the second body 110.

At this time, so as to allow the first body 100 to be coupled to the second body 110, the second body 110 has a locking male screw portion 203 formed along the periphery thereof, and the escape prevention body 200 has a locking female screw portion 202 formed along the inner periphery of one side end portion corresponding to the locking male screw portion 203.

Under the above-mentioned structure, even though the escape prevention body 200 is completely coupled to the second body 110, the first body 100 can sufficiently adjust the head speed in the space between the second body 110 and the escape prevention projection 205 of the escape prevention body 200.

Even if the first body 100 is completely moved backwardly from the second body 110, the locking projection 204 formed along the first body 100 is locked to the escape prevention projection 205 of the escape prevention body 200, thereby preventing further movement of the first body 100. Therefore, if there is no forced separation between the first body 100 and the second body 110, the formation of the escape prevention body 200 prevents the abnormal separation between them.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A practice golf club capable of adjusting head speed having a head (H) attached to an end of a shaft(S) having a grip (G), from which an impact sound is generated through a swing operation, wherein the head (H) comprises: a first body (100) coupled to the end of the shaft (S); a second body (110) having a tubular shape, both ends of which are open and adapted to be screw-coupled to the rear end of the first body (100); a moving weight (140) movably disposed inside the second body (110); a magnet (180) adapted to fix the moving weight (140) to the front end portion of the second body (110) by means of a magnetic force thereof; adjustment means adapted to adjust the gap between the magnet (180) and the moving weight (140) so as to control the strength of the magnetic force of the magnet (180) pulling the moving weight (140); a cap (120) screw-coupled to a rear end of the second body (110); and return means interposed between the cap (120) and the moving weight (140) to return the moving weight (140) to the original position when the moving weight (140) momentarily moves by centrifugal force and collides against the cap (120) to generate an impact sound.

2. The practice golf club according to claim 1, wherein the adjustment means adjusts the distance between the magnet (180) and the moving weight (140) by forming a stepped projection (112) along the inner periphery of the second body (110) contacted with the first body (100) to restrict the movement of the moving weight (140) toward the first body (100) and by fixedly disposing the magnet (180) inside the first body (100) correspondingly to the stepped projection (112) to move the second body (110) screw-coupled to the first body (100) forwardly and backwardly from the first body (100) by forward and reverse rotation of the second body (110).

3. The practice golf club according to claim 2, wherein the first body (100) has a locking projection (204) formed along the periphery thereof, and the second body (110) is screw-coupled to an escape prevention body (200) having a larger inner diameter than the first body (100), such that the first body (100) screw-coupled to the second body (110) is moved forwardly and backwardly inside the escape prevention body (200) by means of screw rotation, the escape prevention body (200) having an escape prevention protrusion (205) formed along the inner periphery of one side end portion thereof in such a manner as to be locked correspondingly to the locking projection (20), thereby preventing the first body (100) from being moved backwardly over the head speed adjustment range and escaped from the second body (110).

4. The practice golf club according to claim 1, wherein the adjustment means adjusts the distance between the magnet (180) and the moving weight (140) by forming the stepped projection (112) along the inner periphery of the second body (110) contacted with the first body (100), by fixedly disposing the magnet (180) having a shaft hole (182) formed at the center thereof on the stepped projection (11), by forming a screw hole (101) at the inside of the first body (100) corresponding to the shaft hole (182), by screw-coupling a gap adjustment screw (103) to the screw hole (101) through the shaft hole (182), and by moving the second body (110) screw-coupled to the first body (100) forwardly and backwardly through the forward and reverse rotation, such that the gap adjustment screw (103) is inserted into and drawn from the shaft hole (182) to push the moving weight (140), thereby adjusting the distance between the moving weight (140) and the magnet (180).

5. The practice golf club according to any one of claims 2 to 4, wherein so as to adjust the strength of the magnetic force applied to the moving weight (140) by varying the distance between the magnet (180) inside the first body (100) and the moving weight (14) inside the second body (110) by means of the screw rotation of the second body (110) screw-coupled to the first body (100) and thus to allow the degree of adjustment to be checked by a trainee's eyes, the first body (100) has a reference scale (172) formed on one side of the outer periphery corresponding to the second body (110) and the second body (110) has a plurality of flight distance adjustment scales (170) formed along the outer periphery thereof corresponding to the first body (100), the plurality of flight distance adjustment scales (170) indicating head speeds proportional to the strength of the magnetic force and the distances (meters and yards) obtained in accordance with the head speeds.

6. The practice golf club according to claim 4, wherein a spring (190) is elastically mounted in a space between the rear portion of the second body (110) and the first body (100) so as to apply an elastic force to the respective bodies.

7. The practice golf club according to claim 1, wherein the return means comprises a return spring (160).

8. The practice golf club according to claim 1, wherein the return means comprises repulsive magnets (162*a* and 162*b*) mounted on the facing faces of the moving weight (140) and the cap (120) in such a manner as to face the same poles as each other, such that the moving weight (140) is returned to the original position by means of the repulsive forces of the repulsive magnets (162*a* and 162*b*).

9. The practice golf club according to claim 1, wherein the head (H) further comprises a plurality of auxiliary bodies (150) selectively screw-coupled between the second body 110 and the cap 120.

10. The practice golf club according to claim 1, wherein the cap (120) has a screw hole (15) formed at the center thereof in such a manner as to be coupled to a sound adjustment screw (158), and the end portion of the sound adjustment screw (158) is protruded from the face of the cap (120) or the auxiliary body (150) against which the moving weight (140) collides, such that the moving weight (140) collides with the end portion of the sound adjustment screw (158), thereby decreasing the strength of the impact sound of the moving weight (140).

11. The practice golf club according to claim 10, wherein the sound adjustment screw (158) has a sound suppressing member mounted on the end portion thereof.

* * * * *